United States Patent [19]

Aitken

[11] 4,310,325

[45] Jan. 12, 1982

[54] METHOD AND APPARATUS FOR THE MANUFACTURE OF FUSECORD

[75] Inventor: Robert M. Aitken, Stevenston, Scotland

[73] Assignee: Imperial Chemical Industries Limited, London, England

[21] Appl. No.: 109,902

[22] Filed: Jan. 7, 1980

[30] Foreign Application Priority Data

Jan. 24, 1979 [GB] United Kingdom ..... 02492/79

[51] Int. Cl.[3] ..... F42C 19/02

[52] U.S. Cl. ..... 86/1 R; 102/275.8; 493/302; 493/948

[58] Field of Search ..... 93/78, 77 FT, 77 CL, 93/80, 94 R, 77 R, 1 F; 53/548, 549, 550, 450; 102/27 R; 156/438; 86/22, 1 R; 493/297, 298, 302, 948, 42, 46–49

[56] References Cited

U.S. PATENT DOCUMENTS

| | | | |
|---|---|---|---|
| 757,580 | 4/1904 | Truyter et al. | 93/78 |
| 3,621,558 | 11/1971 | Welsh et al. | 93/78 X |

FOREIGN PATENT DOCUMENTS

| | | |
|---|---|---|
| 295266 | 8/1928 | United Kingdom . |
| 844442 | 8/1960 | United Kingdom . |
| 1160318 | 8/1969 | United Kingdom . |
| 1221346 | 2/1971 | United Kingdom . |
| 1365487 | 9/1974 | United Kingdom . |
| 1403721 | 8/1975 | United Kingdom . |

*Primary Examiner*—James F. Coan

*Attorney, Agent, or Firm*—Cushman, Darby & Cushman

[57] ABSTRACT

A method and apparatus for the manufacture of explosive fusecord the method comprising continuously advancing and convoluting a carrier tape into hollow tubular form, feeding a stream of explosive material into the tubular carrier tape to form an explosive core encased by the carrier tube and subsequently applying reinforcing materials around said carrier tube, said carrier tape being convoluted by passing through shaping guide means, the passage of the carrier tape through the guide means being assisted by pulling an auxiliary transport belt through the guide means, said transport belt being in frictional contact with said carrier tape.

The method facilitates higher fusecord production speeds by preventing stretching or rupture of the carrier tape.

7 Claims, 7 Drawing Figures

METHOD AND APPARATUS FOR THE MANUFACTURE OF FUSECORD

This invention relates to a method and apparatus for the manufacture of dry spun explosive fusecord. The invention is useful for both incendiary and detonating fusecords.

In one widely used dry spinning process for fusecord manufacture a thin carrier tape of paper or synthetic plastics material is drawn in a vertically downward path through a guide tube wherein the tape is progressively convoluted into the form of a tube (herein termed the carrier tube) with the tape edges overlapping. Dry particulate explosive material, for example, pentaerythritol tetranitrate is continuously fed from a hopper through a nozzle or aperture into the end of the formed tube to form the explosive core of the fusecord, and the encased core is consolidated by passing the tube through compression dies and by helically winding (spinning) strands of wrapping material, for example, yarns or tapes around the tube. An outer sheath of waterproof thermoplastics material is then extruded over the wrapping material. Although various modifications of this method have been proposed from time to time the method generally used is that described, for example, in United Kingdom No. 1,345,233. In this method the diameter of the aperture through which the explosive flows into the carrier tube cannot greatly exceed the diameter of the carrier tube and this diameter restriction limits the rate of flow of explosive material into the tube and consequently restricts the production rate from any given fusecord manufacturing machine. Thus if the production rate is increased beyond a critical maximum by increasing the draw rate of the carrier tape, insufficient explosive powder will be fed into the carrier tube to form the desired explosive core. Moreover, the explosive material tends to 'bridge' in the narrow aperture giving rise to non-uniform flow even at draw speeds lower than the critical maximum. In practice, therefore, the conventional dry spinning fusecord manufacturing apparatus is not capable of sustained production rates much above 20 meters per minute.

However we have devised a method of feeding explosive powder into a carrier tube of convoluted tape which enables the core of explosive fusecord to be formed at a much higher speed. The method which is described in our copending United Kingdom Pat. application No. 7902492 involves continuously advancing a carrier tape in a horizontal linear path, partially convoluting said tape to form a longitudinal open trough portion extending over a feed zone of said path, continuously feeding a stream of explosive material into said trough portion at a controlled rate appropriate to the formation of the desired explosive core, said stream being elongated and extending longitudinally over a portion of said feed zone, further convoluting said tape in a zone subsequent to said feed zone to form a closed tube surrounding and conveying a core of explosive material and subsequently applying reinforcing materials around the said closed tube.

In fusecord manufacture the carrier tape is convoluted by passing through shaping dies, for example, a trough-shaped guide for the partial convolution and a tubular guide for completion of the convolution into tube form. However, when the carrier tape is advanced through such guides at the higher speeds permitted by the aforedescribed explosive core feeding method the friction between the guide and the carrier tape can cause stretching or rupture of the tape with consequent damage of the explosive core. We have found that this damage may advantageously be avoided by carrying the tape through the guides on an auxiliary transport belt made of stronger material such as woven textile fabric.

Thus in accordance with this invention a method of manufacturing explosive fusecord comprises continuously advancing and convoluting a carrier tape into hollow tubular form, feeding a stream of explosive material into the tubular carrier tape to form an explosive core encased by the carrier tube and subsequently applying reinforcing materials around said carrier tube, said carrier tape being convoluted by passing through shaping guide means, the passage of the carrier tape through the guides means being assisted by pulling an auxiliary transport belt through the guide means, said transport belt being in frictional contact with said carrier tape. The auxiliary belt is preferably an endless belt trained around a drive pulley, optionally around tensioning rolls, and through the tape convoluting guide means. It will be apparent that within the guides the auxiliary belt will conform to the surface shape of the carrier tape and, because of the frictional engagement with the carrier tape, much of the longitudinal strain on the carrier tape will be absorbed. The auxiliary belt must be driven at substantially the same speed as the carrier tape although in practice it is preferred to allow some slippage to ensure that the carrier tape is always maintained under tension to prevent bending and rupture of the filled tube.

Preferably the encased explosive core is formed by a method comprising continuously advancing the carrier tape in a horizontal linear path, partially convoluting said tape to form a longitudinal open trough portion extending over a feed zone of said path, forming a substantially uniform layer of powdered explosive material, continuously advancing said layer to the feed zone at a controlled rate, for example, on a conveyor such as a belt or vibratory conveyor disposed at an angle to the carrier tape path, permitting explosive material to fall continuously from the leading edge of said layer into the open trough tape portion and further convoluting said carrier tape in a zone subsequent to said feed zone to form a closed tube around the explosive material. The explosive material feed rate may advantageously be controlled by monitoring the weight per unit length in the fusecord core and adjusting the relative speeds of advance of the explosive layer and the carrier tape in response to any variation from the weight nominally required for the desired explosive core. In practice it will be simpler to maintain a constant carrier tape speed and to adjust the speed of the explosive layer.

The apparatus of the invention comprises draw means to advance a carrier tape in a linear path, shaping guide means to convolute said carrier tape into tubular form, an auxiliary transport belt trained through the guide elements, said transport belt being adapted to conform to the shape of the guide surfaces and frictionally to engage the carrier tape, drive means to pull the auxiliary transport belt through the guide means in the same direction and substantially at the same speed as the carrier tape, feed means to deliver a stream of explosive material to form an explosive core in the carrier tube and means to apply reinforcing material around the tubular carrier tape.

The guide means advantageously comprises elongated guide elements providing internal guide surfaces defining at any given position the desired shape of the carrier tape at that position.

In a preferred apparatus the draw means is adapted to advance the carrier tape in a horizontal path and the feed means comprises a conveying surface adapted to continuously advance powdered material to a feed zone in the carrier tape path and gate means whereby a uniform layer of explosive powder may be continuously formed on said conveying surface, said conveying surface extending between said gate means and said feed zone wherein said uniform layer is in operation continuously discharged onto the said carrier tape. The conveying surface is advantageously provided by a conveyor belt. The feed means preferably comprises feed measuring means for continuously measuring the feed rate and means to adjust the conveyor speed in accordance with the measured feed rate to obtain a substantially uniform explosive loading.

The draw means preferably comprises one or more driven rollers adapted to engage the wrapped fusecord and advance it at a substantially uniform speed.

The invention is further illustrated by the preferred embodiment which is hereinafter described, by way of example, with reference to the accompanying drawings wherein FIG. 1 shows diagrammatically in plan fusecord being manufactured in apparatus in accordance with the invention;

In the drawings like parts are designated by the same numeral.

Figure 1:
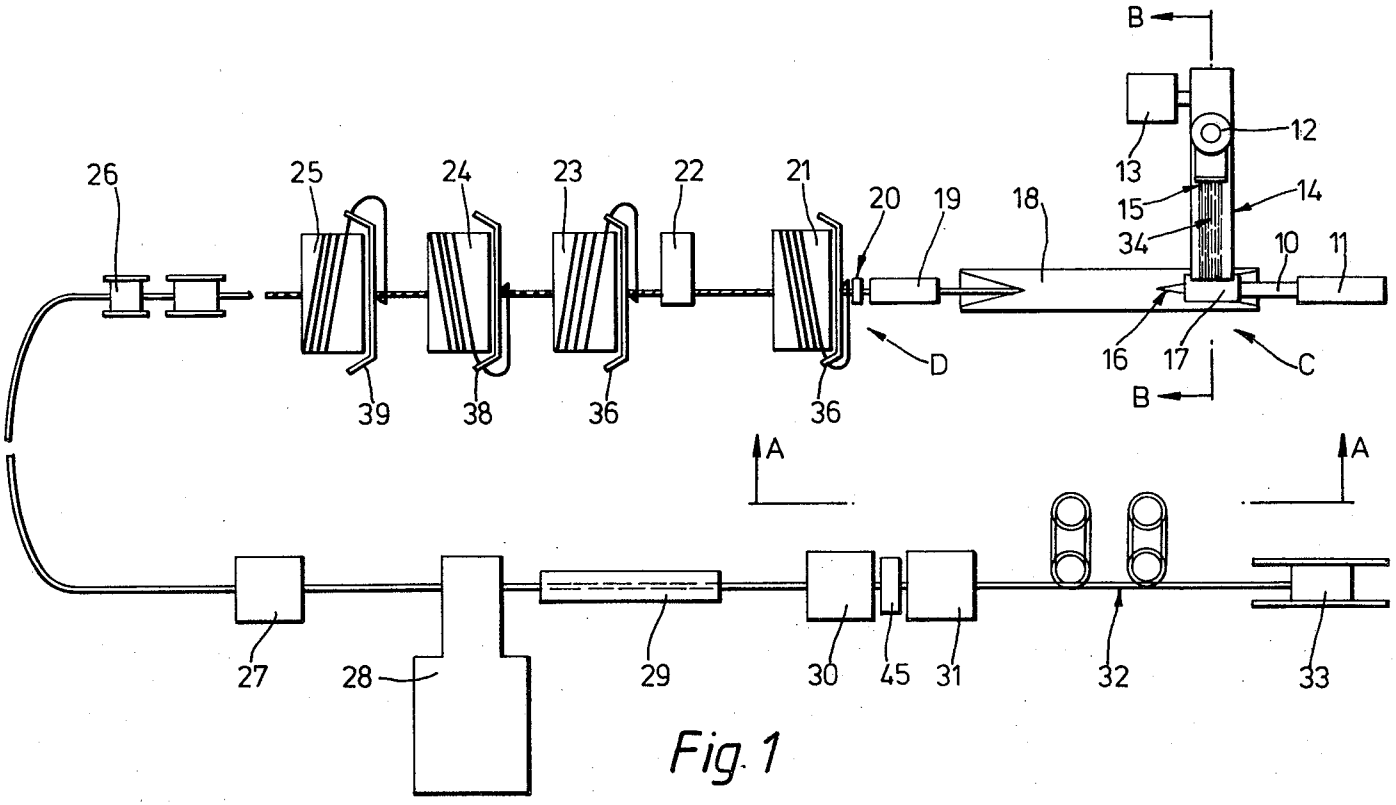
Figure 2:
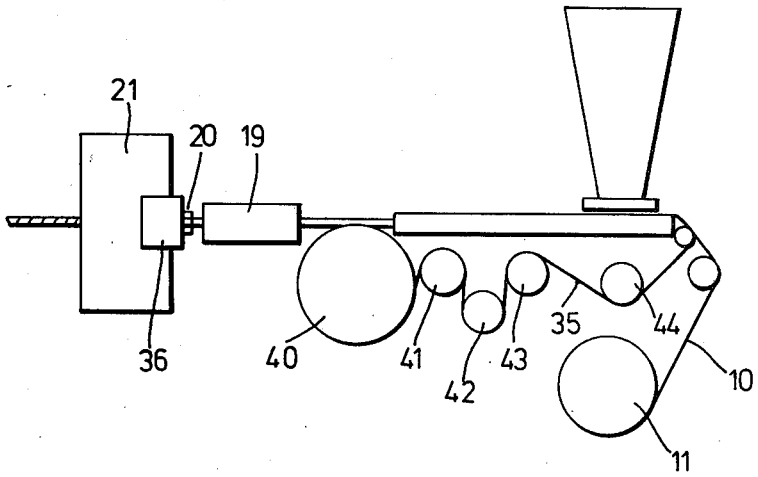
FIG. 2 shows diagrammatically in elevation a portion of the apparatus on the Line AA of FIG. 1.
Figure 3:
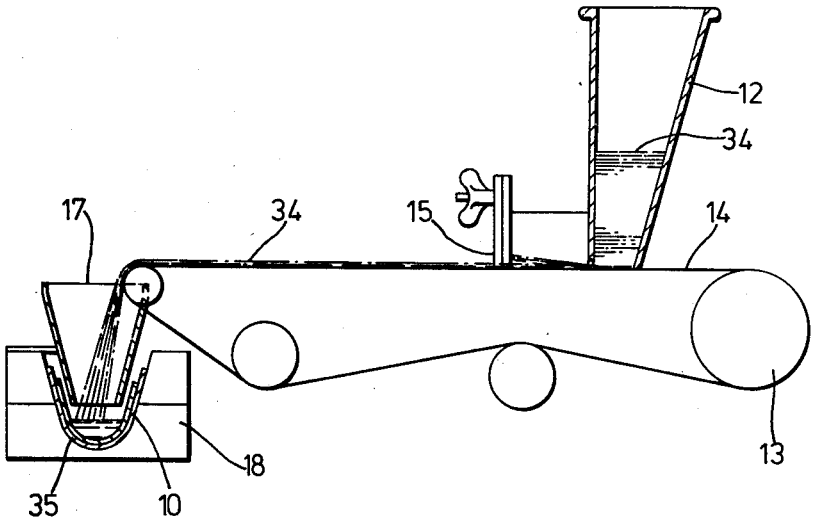
FIG. 3 shows diagrammatically in sectional elevation a portion of the apparatus on the Line BB of FIG. 1.
Figure 4:
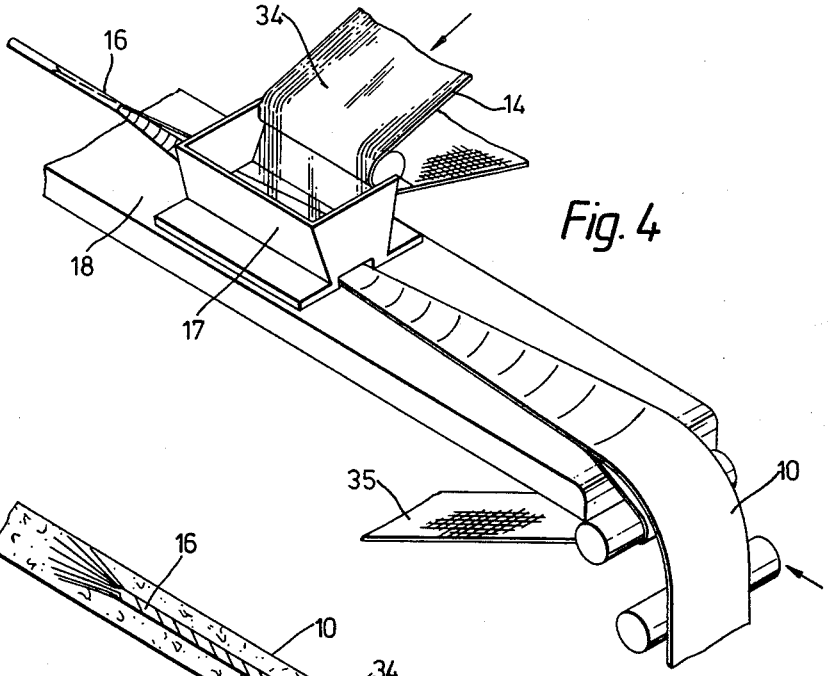
FIG. 4 is a fragmentary view in perspective in the direction of Arrow C in FIG. 1.
Figure 5:
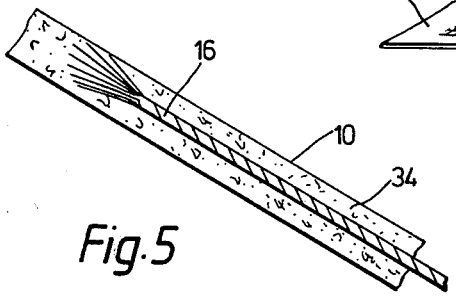
FIG. 5 is a fragmentary view in perspective of part of FIG. 4 on a larger scale.
Figure 6:
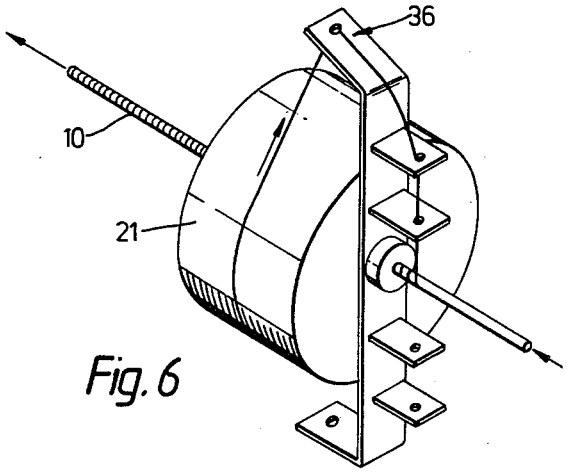
FIG. 6 is a fragmentary view in perspective of a flyer and reel assembly along the Arrow D in FIG. 1.

In the manufacture of explosive fusecord as shown in the drawings a carrier tape 10 is drawn by draw gear 26 from a reel 11 at a substantially constant speed through a tube-forming device 18 where the tape 10 is formed into an open trough of U-shaped cross-section. Explosive powder 34 is fed from a hopper 12 onto a conveyor belt 14 moving under the control of speed-control 13, whereon it is formed into a uniform layer by passing it through an adjustable gate 15 beside the outlet of the hopper 12. The explosive powder 34 is continuously discharged from the forward end of conveyor belt 14 into the trough portion of tape 10. The explosive powder drops freely from the forward edge of the conveyor belt 14 into the trough portion of tape 10 wherein the powder accumulates progressively over the length of tape below the end of the conveyor belt.

As the tape 10 is drawn further into the tube forming device 18 it is closed and overlapped into a tubular form containing a central core of explosive powder 32. A spreader 16 comprising a length of braided wire having a teased-out end portion is attached to the guide 17 and located in the powder stream in the open trough portion of the carrier tape forward of the end of the conveyor belt 14 and extending into the fully closed tube.

In its passage through the tube forming device 18 the tape 10 is supported on an auxiliary transport belt 35 of cotton or similarly strong material which is trained around driven roller 40, guide rolls 41, 42, 43 and 44 and through the tube forming device 16 wherein it conforms in shape to the tape 10. The belt 35 is driven at substantially the same rate as the tape 10 but the frictional contact between the tape 10 and belt 35 is such as to allow slight slippage, thereby enabling the tape 10 to be continuously under tension. With this arrangement any excessive stressing which might break the tape 10 is taken by the belt 35. At the end of the tube forming device 18 the tubular tape 10 leaves the transport belt 35 and is fed into a tube guide 19 wherein the now tubular tape 10 is maintained in its overlapped form and the powder 34 is consolidated. On emerging from the guide 19 the tubular tape 10 is drawn axially through a die 20 to shape the wrapped fuse core to the desired shape and diameter and then through the centres of reels 21, 23, 24 and 25 which are freely mounted on hollow driven hubs, each reel containing either one strand or several strands of wrapping material. The strands are removed from the reels by driven rotatable flyers 36, 37, 38 and 39 attached to the hubs and wrapped around the tubular tape 10 at a fixed rate to provide an even covering on the tubular tape 10. The wrapping material can be counter-spun as desired to give, for example, different finishes, strengths or bending characteristics to the fusecord. A measuring device 22, which is conveniently a Beta-ray monitor, is situated after the reel 21 to measure the cord density. Since the strands of wrapping material are substantially constant in density the measurements indicate the powder charge variation and any slight changes in the charge are rectified by adjusting the belt speed control 13 in response to the measured core density.

Figure 7:
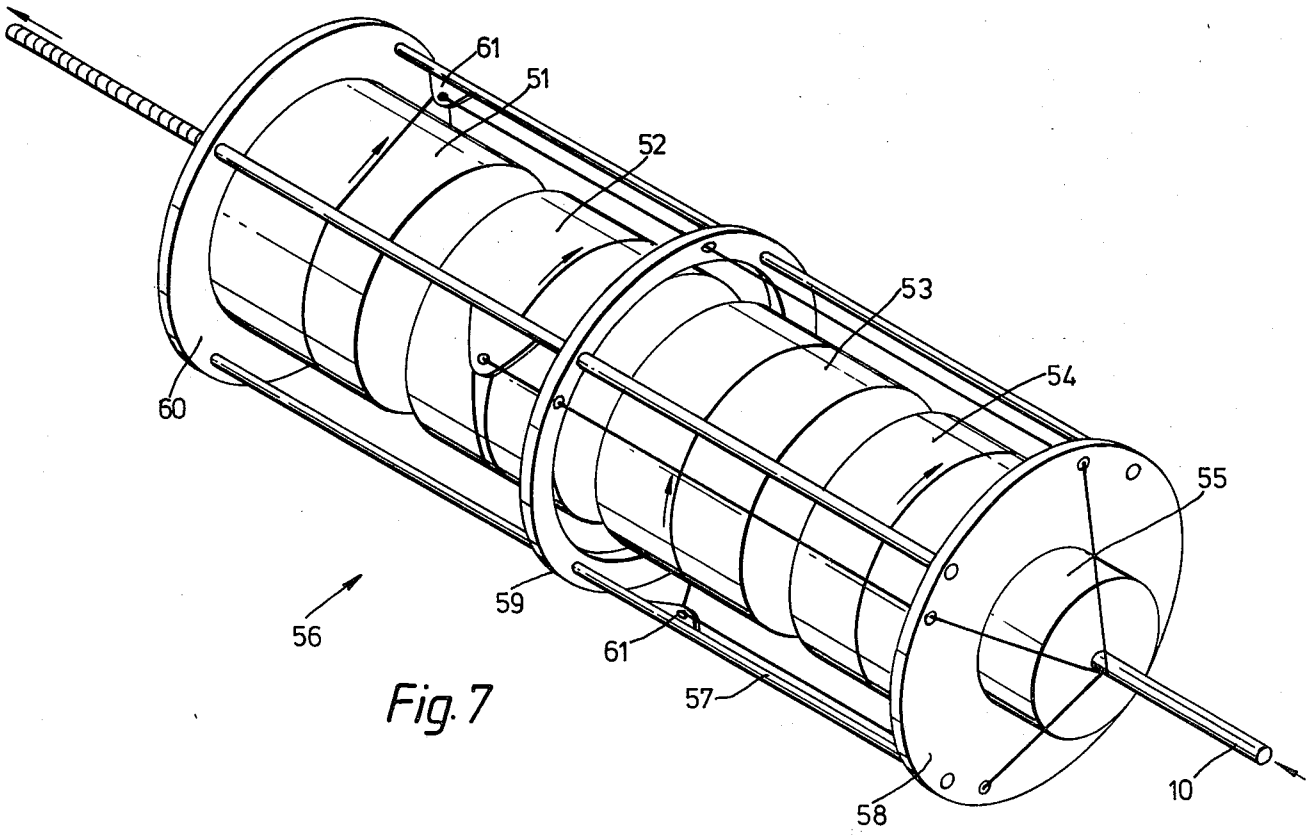
FIG. 7 shows in perspective a modified flyer and reel assembly alternative to that of FIG. 6.

In an alternative and more compact flyer and reel assembly shown in FIG. 7 a number of reels 51, 52, 53 and 54 are freely mounted for rotation on a tubular driven hub shaft 55. The flyer assembly 56 attached to the hub shaft 55 comprises hollow outer guide bars 57 having eyelets 61 through which the strands of wrapping material are threaded. The guide bars 57 are supported on the hub shaft 55 by discs 58, 59 and 60.

Both flyer 56 and hub shaft 55 are driven and, as the strands of wrapping material are helically wound around the tubular tape 10, the reels are pulled by the wrapping material and rotated in the same direction as the hub shaft 55 but at a slightly higher speed.

This alternative assembly becomes more advantageous as the number of reels is increased because it facilitates better control of the positioning of the strands of wrapping material of the fusecord.

The wrapped fusecord next passes the draw-gear 26 and subsequently it is drawn by draw-gear 31 through a detonation trap 27 and an extruder 28 wherein the cord is covered with a synthetic thermoplastics sheath. The draw speed of draw-gear 31 is matched to the speed of draw-gear 26 but small fluctuations in the relative speeds are accommodated by a tensioning device 45. The two draw-gears are used in order to reduce the degree of stretch which might be obtained over the long length of thin fusecore being processed.

After the extruder 28 the cord by draw-gear 31 through a water bath 29 where it is cooled and through a further detonation trap 30. After passing the draw-gear 31 the cord is fed to a further accumulator 32 and then to a driven storage reel 33. Sufficient fusecord can be stored in the accumulator 32 to permit the reels 33 to be changed without stopping the production line. The reel 33 is driven through a slippage device to allow the rotational speed of the reel to alter as fusecord is progressively wound onto the reel without altering the main driving speed whilst allowing a fairly constant torque to be applied to the reel to enable the fusecord to be neatly laid on the reel. If desired the reel 33 may be a small reel on which fusecord is wound for dispatch, but in this case several reel driving heads and a change-over device would be necessary in order to give the operator time to remove the full reels and put on empty reels.

The accumulator 32 comprises sets of pulleys over which the yarn passes, the centre of the pulleys being adjustable in spacing so that a varying length of fuse can be contained between the pulleys.

Each of the draw-gears 26 and 31 comprises a capstan around which the cord is wrapped so that it is frictionally engaged by the capstan. The relative speeds of the draw-gears 26 and 31 are balanced by adjustment of the draw-gear 31 by a tension device 45.

The rate of all the items of the production line can be varied individually but during a production run the relative rates of all items will remain fixed.

On completion of a run the supply reels of wrapping material and carrier tape become empty at approximately the same time. The following change procedure is then adopted.

The extruder 29, the powder feed, the flyer drive, and draw-gears and the reel drive (to reel 33) are stopped. A new tape 10 is fitted and the old one removed. The reels 21, 23, 24 and 25 are all replaced and a wire is put through all items. The new tape 10 and all new strands of wrapping material are tied in turn to the wire as it is pulled through the centre of all items until a full set of wrapping strands and carrier tape is pulled clear at the draw-gear 26. The embryo fusecord (semi-fuse) is now tied to the end of the cord just completed with a small knot to allow it to pass through the extruder die and the complete line run at low speed until the knot has passed through the extruder die. The powder is then re-started and the cord again run until properly filled cord reaches the extruder. The extruder is then restarted and the whole line run up to desired speed.

I claim:

1. A method of manufacturing explosive fusecord comprising continuously advancing and convoluting a carrier tape into hollow tubular form, feeding a stream of explosive material into the tubular carrier tape to form an explosive core encased by the carrier tube and subsequently applying reinforcing materials around said carrier tube, said carrier tape being convoluted by drawing through shaping guide means under tension by draw means located downstream of the guide means, the passage of the carrier tape through the guide means being assisted by pulling an auxiliary transport belt through the guide means, said transport belt being in frictional contact with said carrier tape and moving at a speed substantially the same as the carrier tape so as to allow some slippage between the tape and the belt to ensure that the tape is maintained under tension in the guide means by said draw means.

2. A method as claimed in claim 1 wherein the auxiliary belt is an endless belt trained around a drive pulley and through the tape convoluting guide means.

3. A method as claimed in claim 1 wherein the encased explosive core is formed by continuously advancing the carrier tape in a horizontal linear path, partially convoluting said tape to form a longitudinal open trough portion extending over a feed zone of said path, forming a substantially uniform layer of powdered explosive material, continuously advancing said layer to the feed zone at a controlled rate, permitting explosive material to fall continuously from the leading edge of said layer into the open trough tape portion and further convoluting said carrier tape in a zone subsequent to said feed zone to form a closed tube around the explosive material.

4. An apparatus for manufacturing explosive fusecord comprising draw means to advance a carrier tape in a linear path under tension, shaping guide means to convolute said tensioned carrier tape into tubular form, an auxiliary transport belt trained through the guide means, said transport belt being adapted to conform to the shape of the guide surfaces and frictionally to engage the carrier tape, drive means to pull the auxiliary transport belt through the guide means in the same direction and substantially at the same speed as the carrier tape so as to allow some slippage between the tape and the belt to ensure that the tape is maintained under tension in the guide means by said draw means, feed means to deliver a stream of explosive material to form an explosive core in the carrier tube and means to apply reinforcing material around the tubular carrier tape.

5. An apparatus as claimed in claim 4 wherein the guide means comprises elongated guide elements providing internal guide surfaces defining at any given position the desired shape of the carrier tape at that position.

6. An apparatus as claimed in claim 4 wherein the draw means is adapted to advance the carrier tape in a horizontal path and the feed means comprises a conveying surface adapted to continuously advance powdered material to a feed zone in the carrier path and gate means whereby a uniform layer of explosive powder may be continuously formed on said conveying surface, said conveying surface extending between said gate means and said feed zone wherein said uniform layer is in operation continuously discharged onto the said carrier tape.

7. An apparatus as claimed in claim 4 wherein the auxiliary transport belt is made from woven textile fabric.

* * * * *